US012667166B2

(12) United States Patent
Sartor

(10) Patent No.: US 12,667,166 B2
(45) Date of Patent: Jun. 30, 2026

(54) LOCKING DEVICE FOR A SPORTS SHOE

(71) Applicant: ROSSIGNOL LANGE S.R.L., Montebelluna (IT)

(72) Inventor: Paolo Sartor, Montebelluna (IT)

(73) Assignee: ROSSIGNOL LANGE S.R.L., Montebelluna (IT)

( * ) Notice: Subject to any disclaimer, the term of this patent is extended or adjusted under 35 U.S.C. 154(b) by 17 days.

(21) Appl. No.: 18/403,181

(22) Filed: Jan. 3, 2024

(65) Prior Publication Data

US 2024/0215686 A1 Jul. 4, 2024

(30) Foreign Application Priority Data

Jan. 4, 2023 (EP) ..... 23425003
Jan. 16, 2023 (FR) ..... 2300406

(51) Int. Cl.
*A43B 5/04* (2006.01)
*A43C 11/14* (2006.01)

(52) U.S. Cl.
CPC ..... *A43C 11/1426* (2013.01); *A43B 5/0429* (2013.01); *A43B 5/0456* (2013.01); *A43B 5/0474* (2013.01); *A43C 11/1413* (2013.01)

(58) Field of Classification Search
CPC ... A43B 5/0452; A43B 5/0454; A43B 5/0456; A43B 5/0458; A43B 5/046; A43B 5/0462; A43B 5/0464; A43B 5/0468; A43B 5/0474; A43B 5/048
See application file for complete search history.

(56) References Cited

U.S. PATENT DOCUMENTS 4,756,099 A 7/1988 Walkhoff
4,761,899 A * 8/1988 Marxer ..... A43B 5/0474 36/105
4,839,973 A 6/1989 Dodge
5,134,792 A * 8/1992 Balbinot ..... A43C 11/16 36/118.1

(Continued)

FOREIGN PATENT DOCUMENTS

DE 1932776 A1 1/1971
EP 2057912 A1 5/2009
FR 2652241 A1 3/1991

OTHER PUBLICATIONS

European Search Report and Written Opinion dated Oct. 24, 2023 in priority application No. EP23425003.3; with English machine translation (total 14 pages).

(Continued)

*Primary Examiner* — Sharon M Prange
(74) *Attorney, Agent, or Firm* — Seckel IP, PLLC

(57) ABSTRACT

The locking device (10) for immobilizing a hinge between a shell (2) and a cuff (3) of a sports shoe (1) includes an immobilizing element (22) mobile between an immobilizing position and a release position, and a blade (12) intended to cooperate with the immobilizing element to immobilize the hinge when the immobilizing element is in the immobilizing position, the immobilizing element including a first guide surface (53) and the blade including a second guide surface (54), the first guide surface cooperating with the second guide surface to guide movement of the blade relative to the immobilizing element when the immobilizing element is in the release position and the cuff pivots relative to the shell.

16 Claims, 10 Drawing Sheets

(56) References Cited

U.S. PATENT DOCUMENTS

| | | | | | |
|---|---|---|---|---|---|
| 5,560,128 | A * | 10/1996 | Marega | A43B 5/0474 | 36/118.2 |
| 6,101,745 | A * | 8/2000 | Grandin | A43B 5/0474 | 36/118.2 |
| 6,131,313 | A * | 10/2000 | Pierce | A43B 5/0474 | 36/118.3 |
| 6,263,593 | B1 * | 7/2001 | Pierce | A43B 5/0474 | 36/118.3 |
| 2001/0009324 | A1 | 7/2001 | Okajima | | |
| 2002/0029497 | A1 * | 3/2002 | Pierce | A43B 5/048 | 36/118.3 |
| 2008/0172907 | A1 * | 7/2008 | Sartor | A43B 5/0474 | 36/118.4 |
| 2009/0113763 | A1 | 5/2009 | Narajowski et al. | | |
| 2013/0074373 | A1 * | 3/2013 | Venturato | A43B 5/0474 | 36/117.1 |
| 2013/0097892 | A1 * | 4/2013 | Viniero | A43B 5/0468 | 36/117.1 |
| 2018/0368508 | A1 * | 12/2018 | Gorza | A43B 5/0496 | |
| 2023/0397693 | A1 * | 12/2023 | Quagliotto | A43B 5/0474 | |

OTHER PUBLICATIONS

French Search Report and Written Opinion dated Jul. 6, 2023 in priority application No. FR2300406; with English machine translation (total 20 pages).

* cited by examiner

LOCKING DEVICE FOR A SPORTS SHOE

CROSS-REFERENCE TO RELATED APPLICATIONS

This application claims priority of European patent application No. EP23425003.3 filed Jan. 4, 2023 and French patent application No. FR2300406 filed Jan. 16, 2023, the content of each of which is hereby incorporated by reference herein in its entirety.

TECHNICAL FIELD OF THE INVENTION

The invention concerns a locking device for immobilising a hinge between a shell and a cuff of a sports shoe, in particular a ski boot. The invention also relates to a sports shoe, in particular a ski boot, including a locking device of that kind.

BACKGROUND ART

For skiing there are known sports shoes comprising a shell and a cuff hinged to the shell. The shell envelopes the foot below the ankle while the cuff envelopes the bottom of the leg above the ankle. The hinge between the shell and the cuff allows easy insertion of the foot into the shoe, as well as a natural gait because the articulation of the ankle is not immobilised. When the shoe is used in descent in downhill skiing the hinge between the shell and the cuff must be immobilised in order to control the skis efficaciously.

In order to immobilise or to release the hinge between the shell and the cuff, there is known the use of locking devices, also known as ski-walks. These devices include a lever that can be actuated by hand enabling a choice between two configurations of the shoe. The first, so-called ski configuration immobilises the hinge between the cuff and the shell. The second, so-called walk configuration releases the articulation between the cuff and the shell.

Known prior art locking devices have some or all of the following disadvantages:

- they are complicated to manufacture;
- they are heavy and/or bulky;
- they are difficult to manipulate;
- they do not allow a sufficient amplitude of movement to achieve satisfactory comfort in walking when they are in the walk configuration;
- they do not allow firm immobilising of the cuff relative to the shell when they are in the ski configuration.

Furthermore, the conditions of use of ski boots are particularly severe: they are exposed to very low temperatures and to relatively high humidity. Furthermore, they are liable to receive numerous impacts, in particular if their user should fall. Under these conditions the locking devices integrated into the shoes are damaged too quickly. Once damaged a locking device may become even more difficult to manipulate and/or may no longer immobilise the cuff correctly relative to the shell in the ski configuration, or even become completely unusable.

SUMMARY OF THE INVENTION

The object of the invention is to provide a locking device that remedies the above disadvantages by improving the known prior art locking devices.

In particular, the invention aims to propose locking devices that are simple to manufacture, reliable, robust and easy to manipulate.

The invention relates to a sports shoe, in particular a ski boot, including a shell, a cuff hinged relative to the shell and a locking device for immobilising a hinge between the shell and the cuff, the locking device including:

- an immobilising element mobile between an immobilising position and a release position, and
- a blade fixed to the shell by a rotational connection about a rotation axis, the blade being intended to be moved relative to the immobilising element when the immobilising element is in the release position and the cuff pivots relative to the shell, the blade being intended to cooperate with the immobilising element to immobilise the hinge when the immobilising element is in the immobilising position, the immobilising element including a first guide surface and the blade includes a second guide surface, the first guide surface cooperating with the second guide surface to guide movement of the blade relative to the immobilising element when the immobilising element is in the release position and the cuff pivots relative to the shell.

The blade may include a groove and said second guide surface may be formed by at least one edge of the groove.

The immobilising element may be mobile parallel to a first axis between its immobilising position and its release position and the blade may be moved relative to the immobilising element parallel to a second axis when the cuff pivots relative to the shell, the first axis being perpendicular to the second axis.

The immobilising element may include a lug and the blade may include a first opening having a shape complementary to a shape of the lug, the lug cooperating with the first opening when the immobilising element is in the immobilising position.

The locking device may include a casing provided with a wall extending against the blade, the blade being intended to be moved relative to said wall when the cuff pivots relative to the shell, said wall including a second opening, the lug being positioned inside the second opening when the immobilising element is in the immobilising position.

Said groove may open into said first opening.

The immobilising element may include a first portion, in particular of cylindrical shape, adapted to cooperate with said first opening to immobilise the hinge between the cuff and the shell when the immobilising element is in the immobilising position, and a second portion, in particular of prismatic shape, the second portion having at least one plane face forming the first guide surface.

The immobilising element may be a monobloc element, in particular a monobloc element made of metal.

The blade may include an upper part extending in a first plane and a lower part extending in a second plane parallel to the first plane and offset relative to the first plane.

The locking device may include a casing fixed to the cuff, the casing including a means for guiding movement in translation of the immobilising element parallel to a first axis between its immobilising position and its release position.

The invention also relates to a sports shoe, in particular a ski boot, including a shell, a cuff hinged relative to the shell and a locking device for immobilising a hinge between the shell and the cuff, the locking device including an immobilising element mobile between an immobilising position and a release position, and a conjugate element adapted to cooperate with the immobilising element to immobilise the hinge when the immobilising element is in the immobilising position, the immobilising element being moved away from the conjugate element to release said hinge when the immobilising element is in the release position, the locking device including a shaft secured to the immobilising element, a casing including at least one first guide opening, a carriage mobile relative to the casing, the carriage including at least one second guide opening, the shaft cooperating with the at least one first guide opening and with the at least one second guide opening so that movement of the carriage relative to the casing drives movement of the immobilising element.

The immobilising element may be mobile parallel to a first axis between its immobilising position and its release position, the at least one first guide opening being oriented parallel to the first axis, the carriage being mobile relative to the casing parallel to a second axis, the at least one second guide opening being oriented parallel to a third axis, the third axis being at a non-zero angle to the first axis, the third axis being at a non-zero angle to the second axis.

Said conjugate element may include a blade intended to be fixed to the shell of the sports shoe by a hinge about a rotation axis, the blade being adapted to slide relative to the casing when the immobilising element is in the release position the casing and the blade may have facing metal surfaces, and the locking device may include a sliding element between the casing and blade, the sliding element being configured to facilitate sliding of the blade relative to the casing.

The locking device may further include a cable, the cable having a first end fixed to the carriage to exert a traction force on the carriage, the cable having a second end fixed to a maneuvering means of the sport shoe.

Said second guide opening may be oriented so that movement of the carriage as a consequence of a traction force applied by said cable drives movement of the immobilising element toward its release position.

The locking device may include a return means configured to move the carriage so as to guide movement of the immobilising element toward its immobilising position.

The cuff may comprise an external wall covering a mechanism of the locking device.

The shell may comprise a rear notch, the sports shoe also comprising a rear spoiler rotatable relative to the shell about a rotation axis, the rear spoiler being movable between a first position where it closes the notch and a second position pivoted towards the rear of the shoe.

The invention also relates to a sports shoe, in particular a ski boot, including a shell, a cuff hinged relative to the shell and a locking device for immobilising a hinge between the shell and the cuff, the locking device comprising a casing intended to be fixed to the cuff, and a blade intended to be fixed to the shell, the casing comprising an immobilizing element movable between an immobilizing position and a non-immobilizing position, the immobilizing element interacting with a blade to prevent the rotational articulation between the shell and the cuff when the immobilizing element is in the immobilizing position, the blade being able to slide in the casing when the immobilizing element is in the non-immobilizing position, the casing being intended to be fixed to the cuff along a rotational connection about a fifth axis.

The immobilizing element may comprise a lug, and the blade may comprise an opening comprising a shape complementing a shape of the lug, the lug being positioned inside the opening when the immobilizing element is in the immobilizing position, and the lug being positioned outside the opening when the immobilizing element is in the non-immobilizing position.

BRIEF DESCRIPTION OF THE DRAWINGS

The above objects, features and advantages of the present invention are described in detail in the following non-limiting description of one particular embodiment given with reference to the appended figures in which.

DETAILED DESCRIPTION OF PARTICULAR EMBODIMENTS

Figure 1:
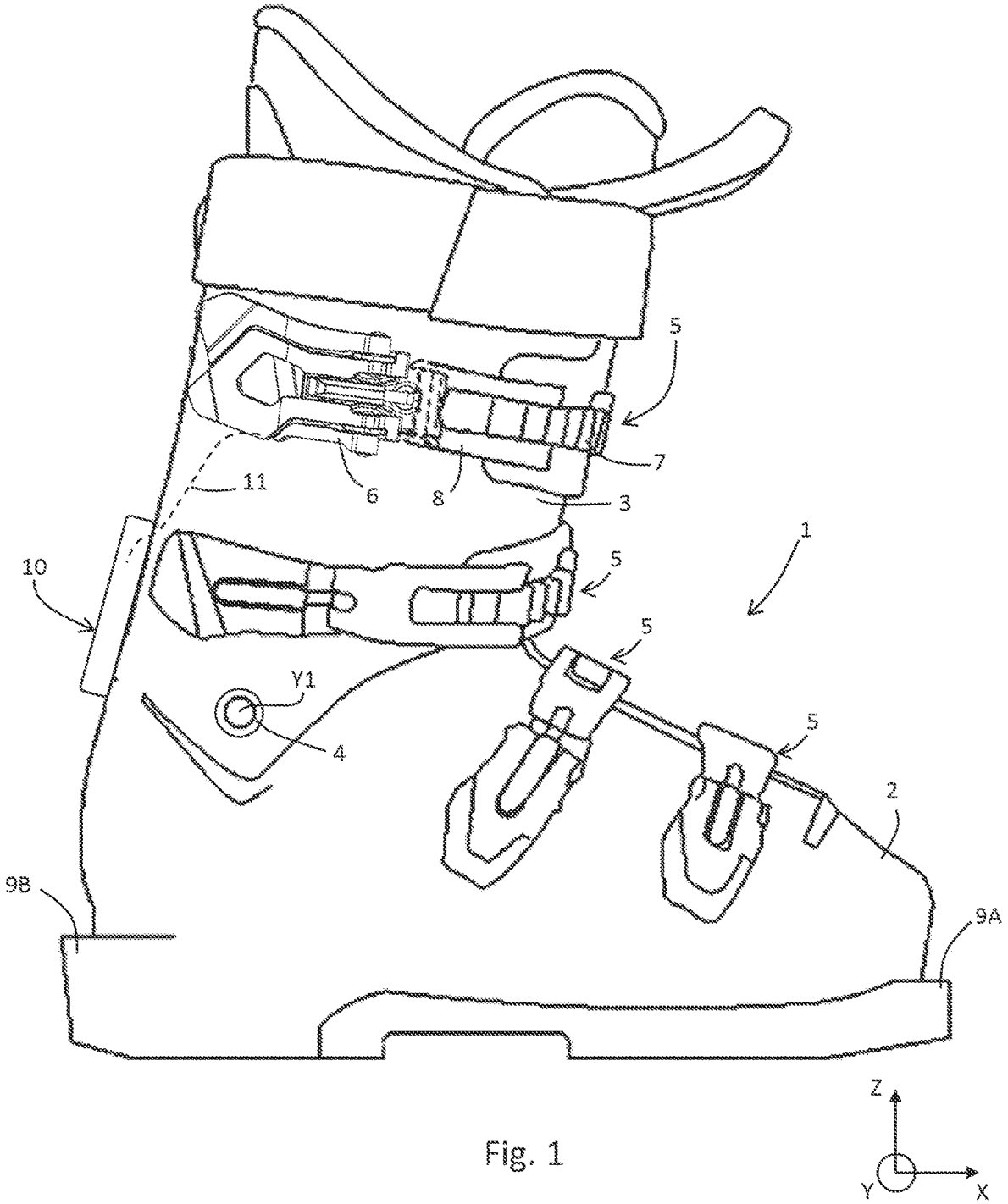
FIG. 1 is a profile view of a ski boot in accordance with one embodiment of the invention.

FIG. 1 depicts diagrammatically a ski boot 1 in accordance with one embodiment of the invention. The ski boot is intended to envelope the foot and the lower leg of a user and to be removably fixed to a ski or the like, in particular a ski, for snow sports. In particular, the ski boot 1 may be suitable for downhill skiing and/or Nordic skiing.

In this document the axis X is the longitudinal axis of the ski boot. The axis X is oriented from the zone of the heel of a user of the ski boot 1 toward the zone of the toes of the user, that is to say in the direction in which a ski fixed to the ski boot extends toward the front. The axis Y is the transverse axis of the ski boot. The axis Y is oriented from left to right, left and right being defined from the point of view of the user. The axis Y is therefore an axis substantially parallel to the articulation axis of the ankle of the user. The axis Z is the axis perpendicular to the axis X and to the axis Y. The ski boot is considered to be resting via its sole on horizontal ground. The axis Z is a vertical axis oriented upward. The axes X, Y and Z form an orthogonal system of axes.

The ski boot 1 includes a shell 2 intended to envelope the foot of the user, a cuff 3 intended to envelope the lower leg of the user, and a hinge means 4 between the shell 2 and the cuff 3. The hinge means 4, for example a rotating joint, is configured to allow rotation of the cuff 3 relative to the shell 2 about a rotation axis Y1 parallel to the axis Y. The rotation axis Y1 is substantially aligned with a rotation axis of the ankle of the user. The rotation axis Y1 passes in particular through the internal and external malleoli of the user.

Note that the present description is essentially limited to explanations relating to a ski boot, without that being interpreted as a limitation of the subject matter of the present invention which, to the contrary, also finds an application in any sports shoe comprising a shell and a cuff hinged about the shell.

The ski boot 1 includes clamping means 5 for tightening the ski boot around the foot and the lower leg of the user. Each tightening means 5 includes a maneuvering device 6 fixed to a first flap of the shell or respectively of the cuff and an attachment means 7 fixed to a second flap of the shell or respectively of the cuff. Each maneuvering device 6 includes a tightening loop 8 cooperating with the attachment means 7 to move the first flap closer to the second flap and therefore to tighten the shell around the foot, or respectively to tighten the cuff around the lower leg. The attachment means 7 may for example include a rack. In accordance with the embodiment described here the ski boot 1 includes two tightening means 5 arranged on the shell and two tightening means 5 arranged on the cuff. Alternatively, the number of tightening means could be different. The shell 2 and the cuff 3 may be made of injection moulded plastic material. The shell 2 further includes a front sole 9A and a rear sole 9B intended to cooperate with a fixing device to fix the ski boot 1 to a ski or the like.

The ski boot 1 further includes a locking device 10 configured to immobilise the hinge between the shell 2 and the cuff 3. The locking device 10 enables use of the shoe either in a so-called "walk" configuration in which the hinge between the shell 2 and the cuff 3 is free or in a so-called "ski" configuration in which the hinge between the shell 2 and the cuff 3 is immobilised. In the walk configuration the ski boot follows the natural articulation of the foot and of the leg, which facilitates walking. In the ski configuration the immobilising of the hinge enables optimum transmission of forces from the foot and from the lower leg to the ski boot, which enables precise guidance of the ski or the like fixed to the ski boot.

The locking device 10 is arranged at the rear of the ski boot. It is represented diagrammatically by a rectangle in FIG. 1. As will emerge in more detail hereinafter, the locking device 10 is advantageously connected by a cable 11 to a maneuvering device 6 of the ski boot, in particular a maneuvering device 6 fixed to the cuff 3. In the embodiment represented here the maneuvering device 6 to which the cable 11 is connected is the highest of the various maneuvering devices 6. Alternatively, the cable 11 could be connected to any other maneuvering device disposed on the boot. The maneuvering device connected to the cable 11 could be independent of a tightening means 5.

Figure 2:
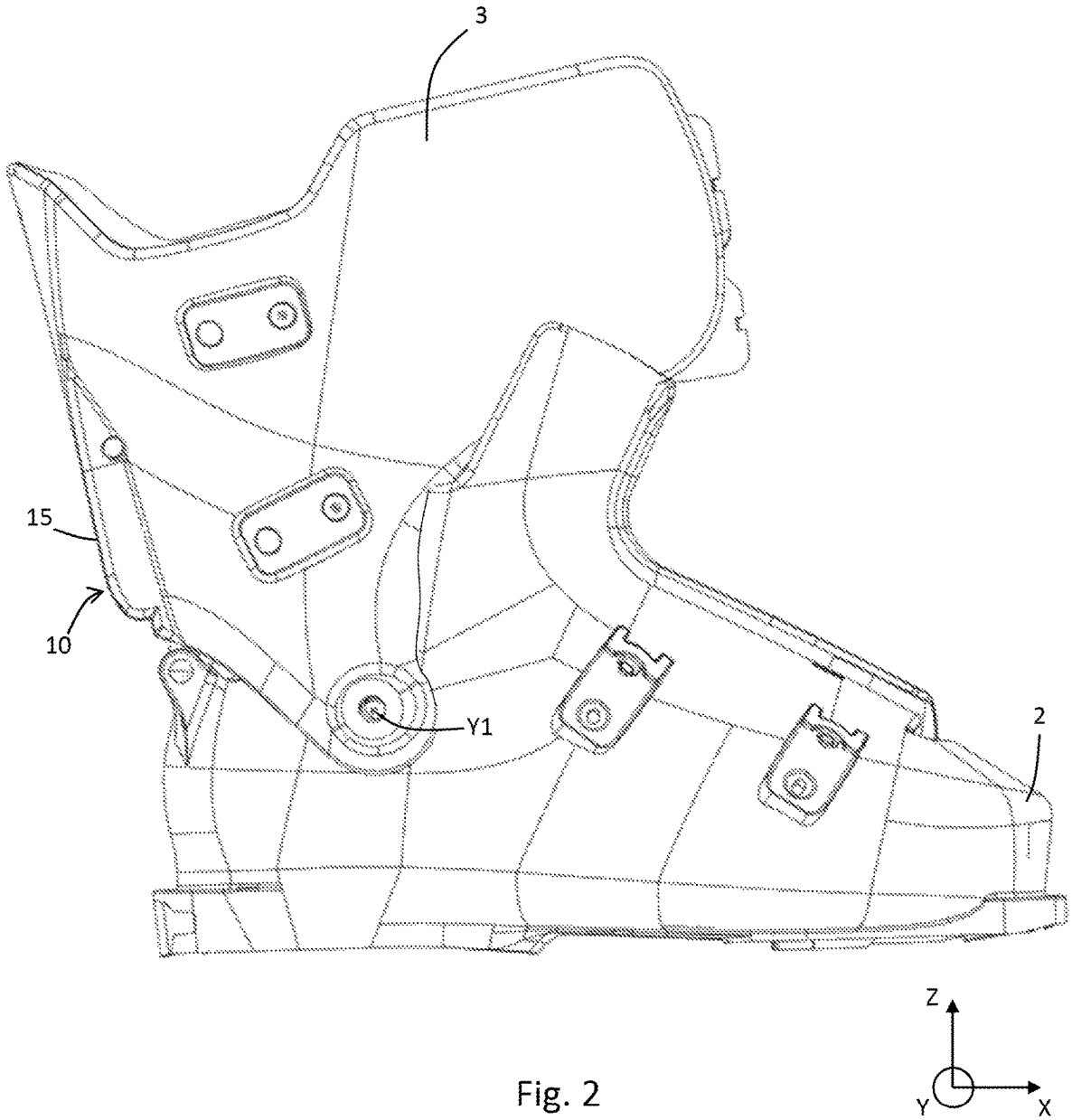
FIG. 2 is a profile view of a part of the ski boot comprising a shell, a cuff and a locking device.

FIG. 2 depicts the shell 2 and the cuff 3 of the ski boot. The locking device 10 is housed at least partially in a protrusion formed at the rear of the cuff 3. The locking device 10 is in particular at least partially covered by an external wall 15 of the cuff. The locking device 10 could equally well be trapped between two layers of the rear wall of the cuff forming a housing to receive the locking device. It is therefore protected from impacts and spattering with snow or ice. To be more precise, and as seen more clearly in FIG. 3, the locking device 10 includes a mechanism 20 secured to the cuff and a conjugate element, or in other words a complementary element, in the form of a blade 12 secured to the shell. The blade 12 is fixed to the shell 2 at its lower end and projects upward. The blade 12 may be a plate of rectangular shape the upper end of which is inserted in the mechanism 20. In accordance with a first embodiment depicted in particular in FIG. 3 the blade 12 may be of rectilinear shape. In accordance with a second embodiment depicted in FIGS. 4 to 6 the blade 12 could have a curved shape in order to guarantee its proper integration along a rear wall of the boot as well as greater mechanical strength, in particular greater resistance to bending. In accordance with this second embodiment the blade 12 includes an upper part 51 extending in a first plane and a lower part 52 extending in a second plane parallel to the first plane and offset relative to the first plane. The first plane and the second plane may extend parallel to the vertical axis Z and to the transverse axis Y for a given inclination of the cuff relative to the shell. The first plane is positioned farther toward the front of the ski boot than the second plane. The first plane and the second plane may be connected by a bent portion. The blade 12 is advantageously a metal blade and is obtained by cutting and bending a metal plate. The bent shape of the blade 12 enables it to espouse the shape of the heel of the ski boot and therefore allows discrete and compact integration of the blade. This shape in particular allows the lower end of the blade to be positioned farther down, which makes it possible to achieve a greater amplitude of rotation of the cuff relative to the shell.

The mechanism 20 is covered by the external wall 15 of the cuff. The mechanism 20 includes a casing 21 provided with a lower opening in which the blade 12 is engaged. The blade 12 is guided in movement in translation inside the casing 21 parallel to the axis along which the blade extends. When the locking device 10 is in the walk configuration the blade 12 is free to slide inside the casing. The blade 12 is therefore mobile in translation relative to the casing 21. When the locking device 10 is in the ski configuration the blade 12, itself joined to the shell, is immobilised inside the casing, itself connected to the cuff. The cuff is therefore prevented from pivoting relative to the shell about the rotation axis Y1.

Figure 4:
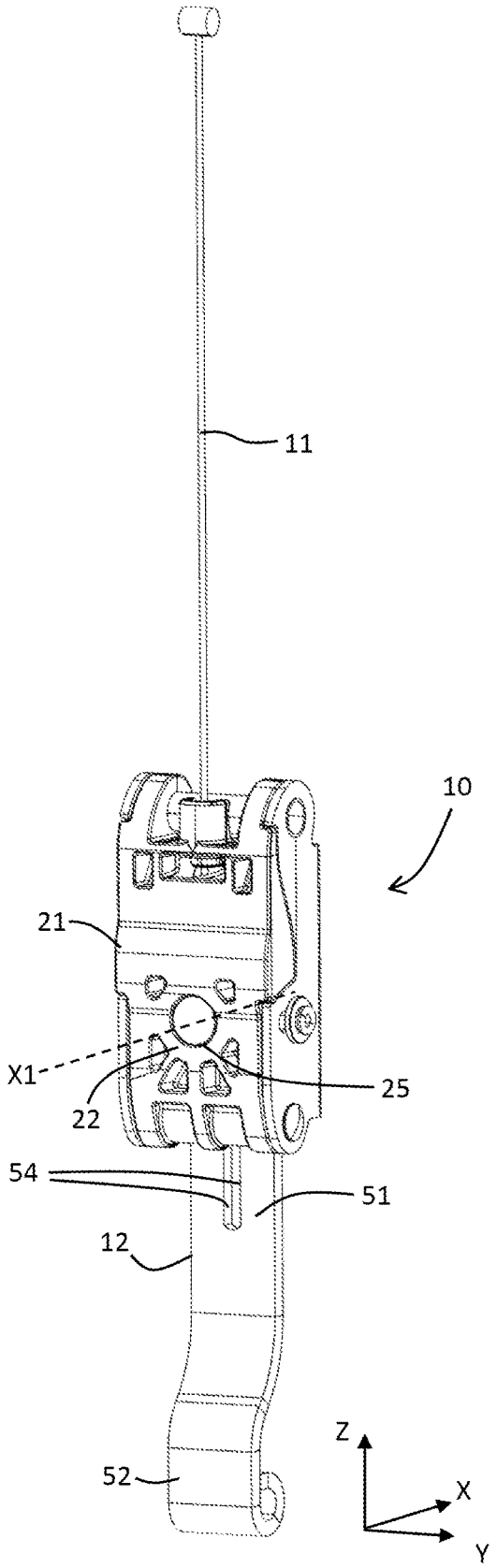
FIG. 4 is a perspective view of a locking device in accordance with one embodiment of the invention, the locking device being in a ski configuration.

FIG. 4 depicts the locking device 10 in the ski configuration. The locking device includes an immobilising element 22 mobile parallel to a first axis X1 between an immobilising position and a release position.

The immobilising position of the immobilising element 22 corresponds to the ski configuration of the locking device 10. The immobilising position is for example a locking position of the immobilising element 22. The blade 12 then cooperates with the immobilising element 22 to immobilise the hinge between the cuff and the shell.

The release position of the immobilising element 22 corresponds to the walk configuration of the locking device 10. The release position is for example an unlocking position of the immobilising element 22. The immobilising element 22 is then positioned relative to the blade 12 so as to free the hinge between the cuff and the shell. The blade 12 is therefore intended to be moved relative to the immobilising element 22 when the immobilising element is in the release position and the cuff pivots relative to the shell. To be more precise, the blade 12 is moved relative to the immobilising element 22 parallel to a second axis Z2 when the cuff pivots relative to the shell. The second axis Z2 is substantially perpendicular to the first axis X1.

The first axis X1 is perpendicular to the plane in which the upper part 51 of the blade extends. For a given orientation of the cuff relative to the shell the first axis X1 may be substantially parallel to the longitudinal axis X and the second axis Z2 may be substantially parallel to the vertical axis Z. When the locking device is in the ski configuration the first axis X1 may for example be at an angle less than or equal to 30° to the longitudinal axis X.

In the embodiment depicted here the immobilising element 22 includes a lug and the blade 12 includes an opening 14 having a shape complementary to the shape of the lug. The lug cooperates with the opening 14 when the immobilising element is in the immobilising position so as to immobilise the hinge between the cuff and the shell. The lug no longer cooperates with the opening 14 when the immobilising element is in the release position.

The immobilising element 22 advantageously also includes a first guide surface 53 and the blade 12 advantageously includes a second guide surface 54, the first guide surface 53 cooperating with the second guide surface 54 to guide the movement of the blade 12 relative to the immobilising element 22 when the immobilising element is in the release position and the cuff pivots relative to the shell. In other words, the guide device includes a permanent guide means between the immobilising element 22 and the blade 12. This makes it possible to guarantee correct positioning of the immobilising element 22 relative to the blade 12 in all circumstances. The immobilising element 22 therefore combines a function of immobilising the blade 12 and a function of guiding the blade. The locking device is therefore easier to manipulate and more robust.

In particular, and thanks to the cooperation of the guide surfaces 53 and 54, the blade 12 is positioned very well relative to the immobilising element 22 at the moment of causing the locking device to go to the locking configuration. This prevents the immobilising element 22 colliding with the edge of the opening 14 in the blade, which would render manipulation particularly delicate and/or require the opening 14 in the blade to be enlarged. The guide means therefore enables the use of an opening 14 in the blade the dimensions of which are well matched to the dimensions of the immobilising element 22. This makes it possible to have no clearance or a minimum clearance between the cuff and the shell when the locking device is in the ski configuration.

Furthermore, thanks to the cooperation of the guide surfaces 53 and 54 the blade 12 is also very well guided in the casing 21 when the locking device is in the walk configuration and the cuff pivots about the shell. In particular, the cooperation of the guide surfaces 53 and 54 assures lateral guiding of the blade in the casing. This therefore prevents the blade 12 coming into contact with a wall of the casing 21 and more generally with any element of the mechanism 20 not intended to come into contact with the blade 12. The locking device is therefore more robust and more durable.

A contrario, if the locking device does not include any guide means between the immobilising element 22 and the blade 12 the immobilising element 22 is then positioned much less precisely relative to the blade 12. On such an assumption, the opening 14 in the blade must be larger to allow for this less precise positioning. Consequently, in the locking configuration there remains a greater clearance between the immobilising element 22 and the blade 12 and the cuff is less well immobilised in position relative to the shell.

Figure 7:
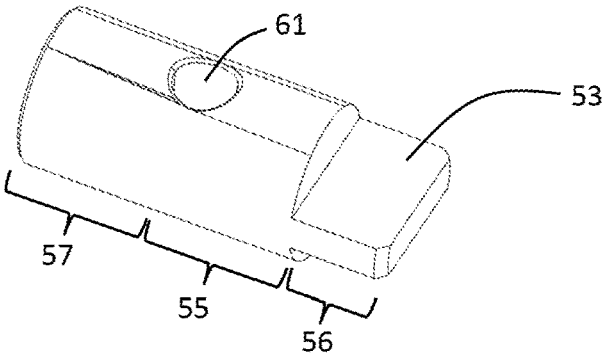
FIG. 7 is a perspective view of an immobilising element of the locking device from FIG. 4.

The immobilising element 22 is depicted in more detail in FIG. 7. It may comprise a plurality of portions along the first axis X1.

The immobilising element 22 includes in particular a first portion 55 intended to cooperate with the opening 14 to immobilise the hinge between the cuff and the shell when the immobilising element is in the immobilising position. The first portion 55 may have a shape complementary to the shape of the opening 14, in particular a cylindrical shape the axis of revolution of which is parallel to the first axis X1. The opening 14 has a circular shape the diameter of which is slightly greater than the diameter of the cylindrical shape of the first portion 55 of the immobilising element.

Alternatively, other shapes could be envisaged for the first portion 55 of the immobilising element 22 and the opening 14, for example a triangular, square, rectangular, polygonal or oval shape. In accordance with other embodiments the immobilising element 22 and the blade 12 cooperating with the immobilising element could be different. These two elements could for example include reliefs, such as rack surfaces for example, intended to come into contact with one another when the immobilising element is in the immobilising position. More generally, the two elements may each include an abutment surface configured to prevent the conjugate element from sliding in the mechanism 20 when the immobilising element is in the immobilising position.

The immobilising element 22 also includes a second portion 56 including said first guide surface 53. This second portion may have at least one plane face. The at least one plane face may extend parallel to the axis on which the blade 12 is moved relative to the guide element 22, that is to say parallel to the second axis Z2. This plane face is intended to bear against the blade 12 to guide the movement of the blade relative to the immobilising element.

The second portion 56 preferably includes two opposite plane faces both forming first guide surfaces. The second portion 56 may have a prismatic shape, in particular a parallelepipedal shape. The second portion 56 may be adjacent to the first portion 55 and may be positioned more toward the front of the ski boot.

Alternatively, the second portion could have a different shape, for example a cylindrical shape. In accordance with another variant embodiment the immobilising element 22 could have a conical or frustoconical shape, the base of the conical or frustoconical shape forming the first portion and the tip of the conical or frustoconical shape forming the second portion.

When the immobilising element 22 is in the release position the second portion 56 cooperates with the second guide surface 54. In particular, the second portion 56 slides along the second guide surface 54 when the cuff pivots relative to the shell. Because of the cooperation between the two glide surfaces 53, 54 only movement of the blade in only one direction is possible. In the immobilising position as in its release position the blade 12 therefore cooperates with the immobilising element 22.

The casing 21 advantageously includes a guide means 25 able to guide the immobilising element 22 in movement in translation parallel to the first axis X1. This guide movement 25 in particular takes the form of a jacket the shape of which corresponds to the profiled shape of the immobilising element 22. This guide means enables good control of the movement in translation of the immobilising element 22 and thus further limitation of any risk of jamming between the immobilising element and the blade 12.

The immobilising element 22 may therefore include a third portion 57, in particular of cylindrical shape, cooperating with the jacket of complementary shape in the casing 21 to guide the immobilising element in movement in translation parallel to the first axis X1.

The diameter of the third portion 57 may advantageously be strictly greater than the diameter of the first portion 55. The shoulder formed at the interface between the third portion 57 and the first portion 55 is therefore able to come into abutment against the edge of the opening 14, which enables good immobilisation of the blade 12 when the locking device is in the ski configuration.

The immobilising element 22 may advantageously be a monobloc element, that is to say an element formed in one piece. The immobilising element could for example be obtained by machining a block of metal. Alternatively, the immobilising element could comprise a plurality of parts fixed together and the various portions 55, 56 and 57 of the immobilising element could for example be bolted or welded together. The immobilising element 22 is preferably made of metal so as to resist the high forces that a user may exert during downhill skiing. Alternatively, it could also be made of injection-moulded plastic, in particular plastic charged with glass fibres or carbon fibres in order to strengthen it.

Figure 6:
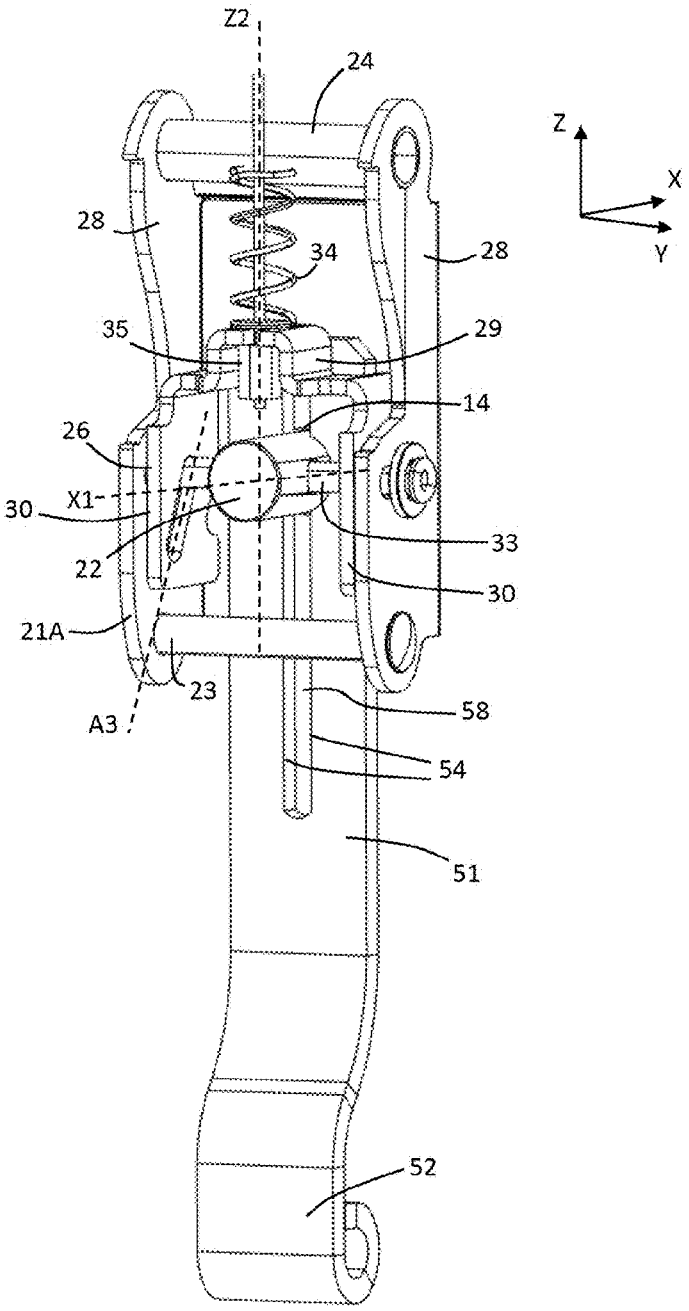
FIG. 6 is a perspective view of a part of the locking device from FIG. 4.

As can be seen in FIG. 6, the casing 21 may have a globally parallelepipedal shape. The casing 21 may have a first part 21A and a second part 21B forming a cover for the first part 21A. The guide means 25 is formed in the second part 21B of the casing. The first part 21A and the second part 21B are rigidly fixed to one another, in particular by means of two pins 23 and 24 cooperating with holes in a lower edge and an upper edge respectively of each of the two parts 21A and 21B of the casing 21. The casing 21 may be made of a plastic material and/or metal. In particular the first part 21A may be made of metal and/or the second part 21B may be made of plastic.

The blade 12 advantageously includes a groove 58. The groove 58 is an opening passing through the thickness of the blade and extending parallel to the axis along which the blade extends, that is to say parallel to the second axis Z2. The groove is delimited by two lateral edges extending parallel to the second axis Z2. The length of the groove 58 along the second axis Z2 is adapted as a function of the amplitude of flexing of the cuff relative to the shell. Said second guide surface 54 is formed by at least one of the two edges of the groove 58, in particular by the combination of the two edges, the two edges being intended to bear on the plane faces of the second portion 56 of the immobilising element 22.

The distance separating the two edges of the groove may be slightly greater than the width of the second portion 56 of the guide element 22 along the transverse axis Y. There may for example be a clearance less than or equal to 3 mm, or even less than or equal to 2 mm, or even less than or equal to 1 mm between the edges of the groove 58 and the second portion 56 of the guide element 22. This achieves satisfactory guiding of the blade 12, which is able to be moved relative to the immobilising element without excessive friction.

The groove 58 may open onto the opening 14. The combination formed by the groove 58 and the opening 14 therefore forms a single opening with a closed edge the shape of which is a keyhole shape. The blade 12 is therefore particularly simple to manufacture.

In accordance with a variant embodiment the blade 12 could have no groove 58 and the guiding between the immobilising element 22 and the blade 12 could be different. For example, the blade 12 could have a U-shape profiled shape. The wings of the U would be spaced by a distance slightly greater than the diameter of the immobilising element so that the immobilising element slides between these two wings when the cuff pivots relative to the shell. In accordance with another variant embodiment the immobilising element 22 could be substantially M-shaped, including a central part intended to cooperate with the opening 14 and lateral wings intended to bear on the outside edges of the blade 12.

The mechanism 20 enables the immobilising element 22 to be moved between its immobilising position and its release position in a particularly advantageous manner. This mechanism 20 is described in more detail next with reference to FIGS. 7 and 8.

In addition to the casing 21 and the immobilising element 22 described above, the mechanism 20 includes a carriage 26 mobile relative to the casing 21 parallel to the second axis Z2. The second axis Z2 may be substantially parallel to the vertical axis Z for a given orientation of the cuff relative to the shell.

The first part 21A of the casing 21 has two lateral flanks 28 extending parallel to one another and connected to one another by a wall 59 forming a bottom of the casing and by the two pins 23 and 24. The blade 12 extends between the wall 59 and the carriage 26. The carriage 26 is globally U-shaped. The carriage includes in particular a base 29 and two lateral flanks 30 connected to the base 29. The lateral flanks 30 of the carriage extend parallel to one another along internal faces of the lateral flanks 28 of the casing. The lateral flanks 28 of the casing cooperate with the lateral flanks 30 of the carriage so as to form a means for guiding movement in translation of the carriage relative to the casing. The carriage is connected to the cable 11 in particular by way of its base 29. A first end of the cable 11 is inserted through a hole provided in the base 29 of the carriage 26. This first end is provided with a retaining means 35 intended to bear on the edge of said hole. Pulling the cable 11 therefore drives sliding, or in other words movement in translation, of the carriage 26 inside the casing 21 parallel to the second axis Z2.

Figure 8:
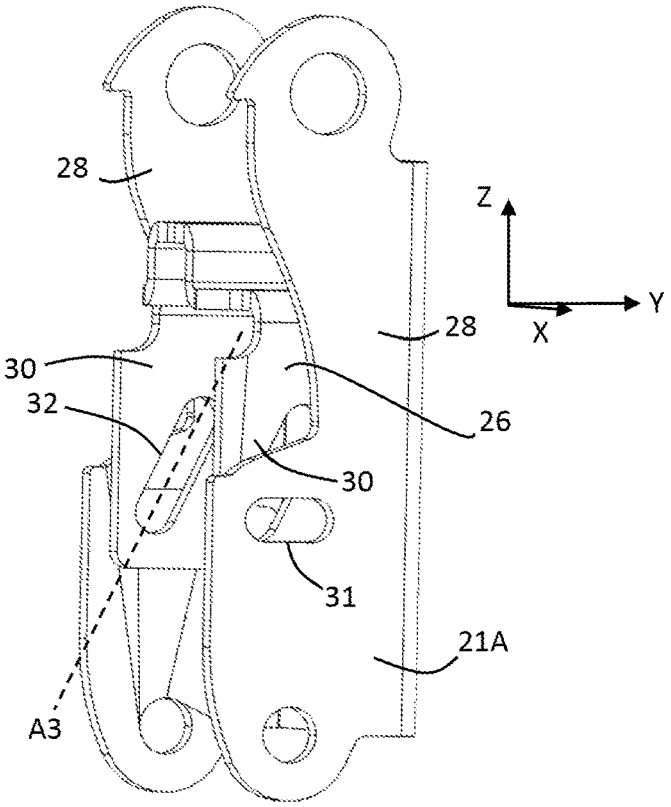
FIG. 8 is a perspective view of a first part of a casing and a carriage of the locking device from FIG. 4.

In FIG. 8 there are represented only the first part 21A of the casing 21 and the carriage 26. The two lateral flanks 28 of the casing 21 each include a first guide opening 31 oriented parallel to the first axis X1. The two lateral flanks 30 of the carriage 26 each include a second guide opening 32 oriented parallel to a third axis A3. The third axis A3 is at an angle B other than 90° to the first axis X1.

The guide openings 31 and 32 are through-openings of oblong shape in the flanges 28 and 30 respectively of the casing 21 and of the carriage 26 respectively. The orientation of a guide opening 31, 32 designates the orientation in which the oblong shape extends. In other words the orientation of a guide opening 31, 32 is parallel to the orientation of the greatest dimension of the guide opening.

The mechanism 20 also includes a shaft 33 secured to the immobilising element 22. The shaft 33 extends globally parallel to the transverse axis Y and passes through the immobilising element 22. The shaft 33 may be rigidly fixed to the immobilising element 22 or inserted with clearance in a transverse opening 61 provided in the immobilising element. In accordance with a variant embodiment the shaft 33 and the immobilising element 22 could form a single part. Moreover, the shaft 33 is arranged through the guide openings 31 and 32. The guide openings 31 and 32 have a width slightly greater than the diameter of the shaft 33 so that the shaft 33 is able to slide freely in these guide openings. The shaft 33 may include stop means at each of its ends to guarantee it is maintained correctly in position through the guide openings 31 and 32.

Figure 9:
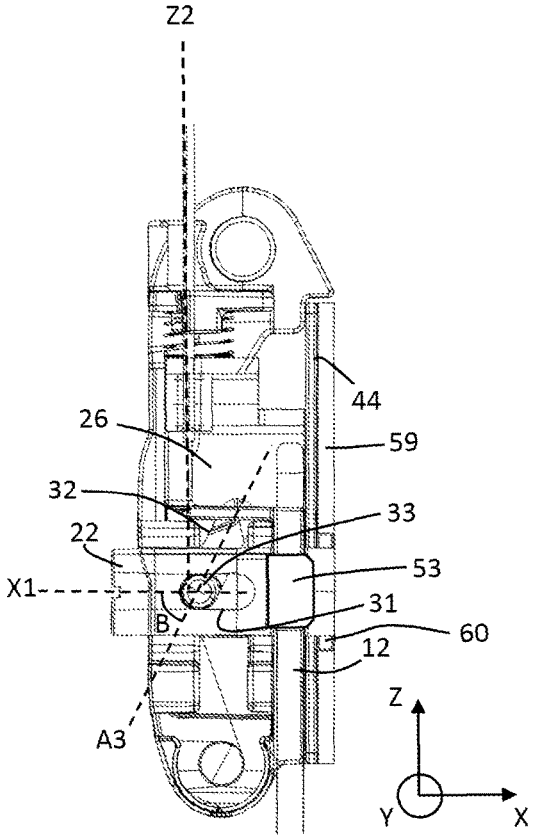
FIG. 9 is a view in vertical longitudinal section of the locking device from FIG. 4, the locking device being in the walk configuration.

When the carriage 26 is in the top position, as represented in FIG. 9, the second guide openings 32 are positioned facing a rear end of the first guide openings 31. The shaft 33 extending through the first guide openings 31 and the second guide openings 32 is therefore in a more rearward position. The immobilising element 22, fastened to the shaft 33, is then in the release position.

Figure 10:
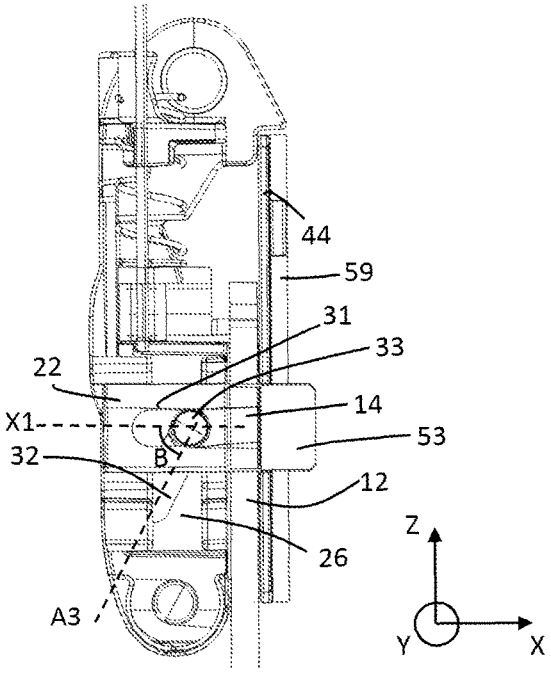
FIG. 10 is a view in vertical longitudinal section of the locking device from FIG. 4, the locking device being in the ski configuration.

Conversely, when the carriage 26 is in the bottom position, as represented in FIG. 10, the second guide openings 32 are positioned facing a front end of the first guide openings 31. The shaft 33 is therefore in a more forward position. The immobilising element 22 is then in the immobilising position. The immobilising element 22 is thus able to come into engagement with the opening 14 of the blade 12.

When the carriage 26 is moved relative to the casing 21 along the second axis Z2 the edges of the guide openings 32, which extend parallel to the third axis A3, bear on the shaft 33, which forces movement of the shaft 33. The shaft 33 being also guided by the guide openings 31, the shaft 33 necessarily moves parallel to the first axis X1. Consequently the movement of the carriage 26 along the second axis Z2 automatically drives movement of the immobilising element 22 along the first axis X1. It is therefore clear that the shaft 33 cooperates with the guide openings 28 and 30 so that movement of the carriage 26 relative to the casing parallel to the second axis Z2 drives movement of the immobilising element parallel to the first axis X1.

The mechanism 20 enables conversion of the substantially vertical movement of the carriage 26 into a substantially longitudinal movement of the immobilising element. The mechanism 20 bringing about this conversion is both particularly compact and reliable. The mechanism 20 may therefore be controlled by means of a cable 11 extending parallel to a wall of the ski boot. In accordance with the embodiment depicted here the cable 11 extends upward from the mechanism 20 but in a variant the locking device could be adapted so that the cable 11 extends towards the right-hand side or the left-hand side, or downward, or in any direction perpendicular to the first axis X1.

The closer to 90° the angle B between the first axis A1 and the third axis A3, the greater the travel of the carriage 26 must be to move the immobilising element 22 between its immobilising position and its release position, which contributes to the increase in the volume of the mechanism 20. This angle B is necessarily different from 90° because otherwise the movement of the carriage would not generate any movement of the shaft 33.

Furthermore, the closer to 0° the angle B between the first axis A1 and the third axis A3, the greater the reaction forces of the shaft 33 on the edges of the openings 31 and 32, which can generate friction forces and premature wear of the mechanism. The angle B between the third axis A3 and the first axis X1 may advantageously be between 10° and 85° inclusive, preferably between 40° and 75° inclusive, more preferably between 50° and 70° inclusive.

The mechanism 20 further includes a return means 34 configured to move the carriage 26 in the direction opposite to the direction of movement driven by actuation of the cable 11. The return means 34 may in particular be a compression spring having a first end bearing against the base 29 of the carriage and a second end bearing against a wall of the second part 21B of the casing. When a traction force is exerted on the cable 11 the carriage 26 is moved upward and the compression spring is compressed. The immobilising element 22 is therefore no longer engaged with the blade 12 and the mechanism is an unlocking position. When the cable 11 is released, the compression spring pushes the carriage down. The immobilising element 22 therefore cooperates with the opening 14 in the blade 12 and the mechanism is in a locking position. Alternatively, the arrangement of the cable could be modified. The cable could for example exert a downward traction force on the carriage 26 and the return means could tend to raise the carriage.

The guide openings 32 of the carriage are oriented downward and rearward, and so the bottom position of the carriage corresponds to the immobilising position of the immobilising element and the top position of the carriage corresponds to the release position of the immobilising element. The cable 11 pulling on the carriage 26 therefore drives the movement of the immobilising element toward its release position. Conversely, in the absence of tension on the cable 11 the immobilising element is in its immobilising position.

Alternatively, the guide openings 32 could be oriented downward and forward so that the top position of the carriage corresponds to the immobilising position of the immobilising element and the bottom position of the carriage corresponds to the release position of the immobilising element.

The cable 11 advantageously has a second end fixed to a maneuvering device 6 articulated on the ski boot. The user can therefore easily control the configuration of the ski boot by manipulating the maneuvering device 6.

Figure 11:
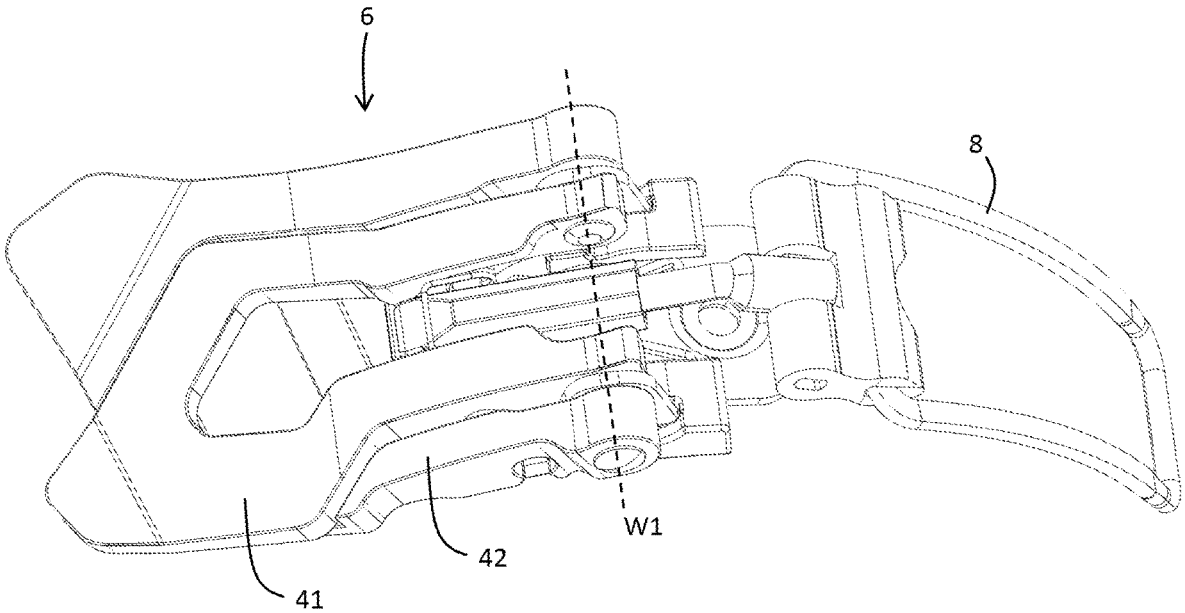
FIG. 11 is a perspective view from above of a maneuvering device of the ski boot.
Figure 12:
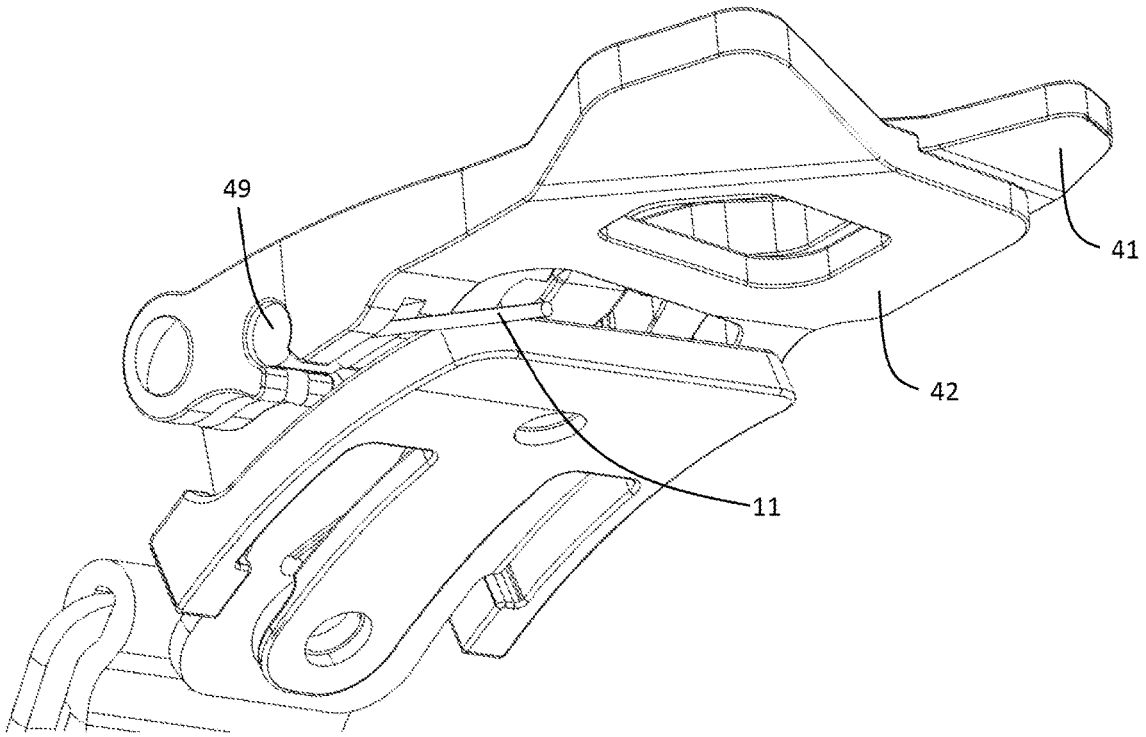
FIG. 12 is a perspective view from below of the maneuvering device from FIG. 11.

FIGS. 11 and 12 depict one embodiment of a maneuvering device 6 connected to the cable 11. The maneuvering device 6 includes a first lever 41 secured to a clamping loop 8 and a second lever 42 separate from the first lever 41 and secured to the cable 11.

The first lever 41 is mobile between a first or closed position and a second or open position. When the first lever 41 is in its first position it is able to exert a traction force on the clamping loop 8 and thus enables tightening of the ski boot around the foot and/or the lower leg of the user. Conversely, when the first lever 41 is in its second position the corresponding tightening means 5 is loosened, which enables the two flaps of the shell or of the cuff to be moved apart, for example in order to insert or extract the foot of the user of the ski boot.

Likewise, the second lever 42 is mobile between a first position and a second position. When the second lever 42 is in its first position it exerts no traction force on the cable 11. The immobilising element 22 is then in its immobilising position thanks to the effect of the return means 34. Conversely, when the second lever 42 is in its second position the cable 11 is under tension. The carriage 26 is then moved against the return means 34 and the immobilising element 22 is in the release position. The hinge between the cuff and the shell is released and the cuff is able to pivot toward the rear or toward the front.

In FIGS. 11 and 12 the two levers 41 and 42 are both represented in their first position. The first lever 41 and the second lever 42 are configured to bear on one another so that when the first lever 41 is in its first position the second lever is automatically in its first position and when the second lever 42 is in its second position the first lever 41 is automatically in its second position.

In particular, the first lever 41 and the second lever 42 are articulated about a common rotation axis W1. When the levers 41 and 42 are in their first position the first lever extends above the second lever 42. A lower face of the first lever 41 bears against an upper face of the second lever 42.

The second end of the cable 11 includes a retaining means 49, of cylindrical shape for example. This retaining means 49 is mounted in a housing of complementary shape provided on the internal face of the second lever. Alternatively, any system for retaining the end of the cable on the lever may be envisaged. The second end of the cable 11 is therefore fixed to the second lever 42 by a rotational connection parallel to the rotation axis W1. When the second lever 42 pivots about the rotation axis W1 from its first position to its second position the cable 11 is therefore tensioned and is naturally oriented in an appropriate direction.

Between its first end and its second end the cable 11 may be protected by a sheath and inserted in a hole formed in the cuff. A channel may be provided along an internal face of the cuff to guide the cable.

When the user causes the first lever 41 to move from its second position to its first position there are simultaneously achieved the tightening of the boot around the foot or the lower leg of the user and the passage of the locking device 10 into the ski configuration. As the locking device is automatically in the ski configuration as soon as the user tightens their boot around the foot or the lower leg, there is no longer any risk of practising downhill skiing with the locking device in the walk configuration, that is to say with the hinge between the shell and the cuff not immobilised.

Conversely, when the user causes the second lever 42 to move from its first position to its second position there are achieved simultaneously the loosening of the boot around the foot or the lower leg of the user and the passage of the locking device into the walk configuration.

The user can also use the ski boot 1 with the first lever 41 in the second position and the second lever 42 in the first position. The boot is then loosened around the foot or the lower leg of the user but the hinge between the shell and the cuff remains locked. A configuration of this kind enables downhill skiing with less compression of the foot or of the lower leg. The comfort of the user can therefore be improved while retaining relatively precise guidance of the skis. A configuration of this kind may equally be particularly suited to waiting situations that do not necessitate walking in the ski boots, for example when a user is on a ski lift.

Figure 3:
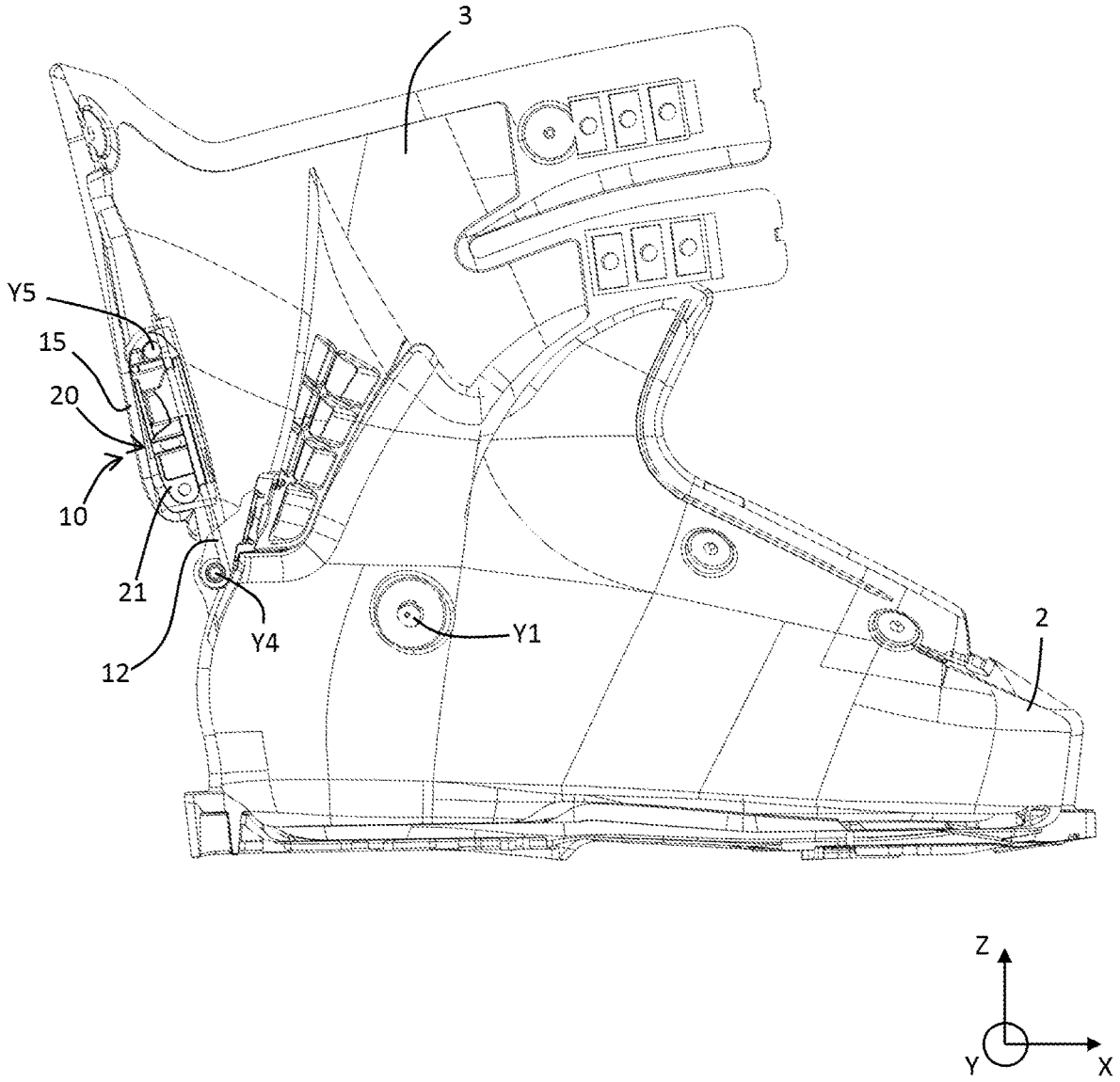
FIG. 3 is a view in vertical longitudinal section of the part of the ski boot from FIG. 2.

The blade 12 is fixed to the shell 2 by a rotational connection about a fourth axis Y4 parallel to the transverse axis Y. To this end the shell 2 includes two protuberances formed substantially in the heel zone and supporting a pin 43 extending along the rotation axis Y4. As can be seen in FIG. 3, the lower end of the blade 12 may simply be wound around the pin 43 to form said rotational connection. The rotational connection of the blade 12 enables the blade to track the movement of the cuff when the latter pivots relative to the shell about the rotation axis Y1. Note that when the cuff pivots relative to the shell the blade 12 pivots about the axis Y4 in the frame of reference of the shell and is moved in translation along the second axis Z2 in the frame of reference of the immobilising element 22.

In accordance with a variant embodiment the blade 12 could not be mobile in rotation about the rotation axis Y4. It could then for example have some flexibility enabling the cuff to pivot relative to the shell about the rotation axis Y1. The amplitude of rotation between the cuff and the shell could then be reduced. In accordance with another variant the blade 12 could be replaced by an assembly comprising a plurality of parts articulated to one another.

In accordance with another original aspect of the invention the casing 21 is fixed to the cuff 3 by a rotational connection about a fifth axis Y5 parallel to the transverse axis Y. In particular, the casing 21 is hinged on the pin 24. The pin 24 may for example be a hollow pin through which passes a rod secured to the cuff 3. Alternatively, the casing could be hinged to the cuff by another pin, for example the pin 23.

Figure 13:
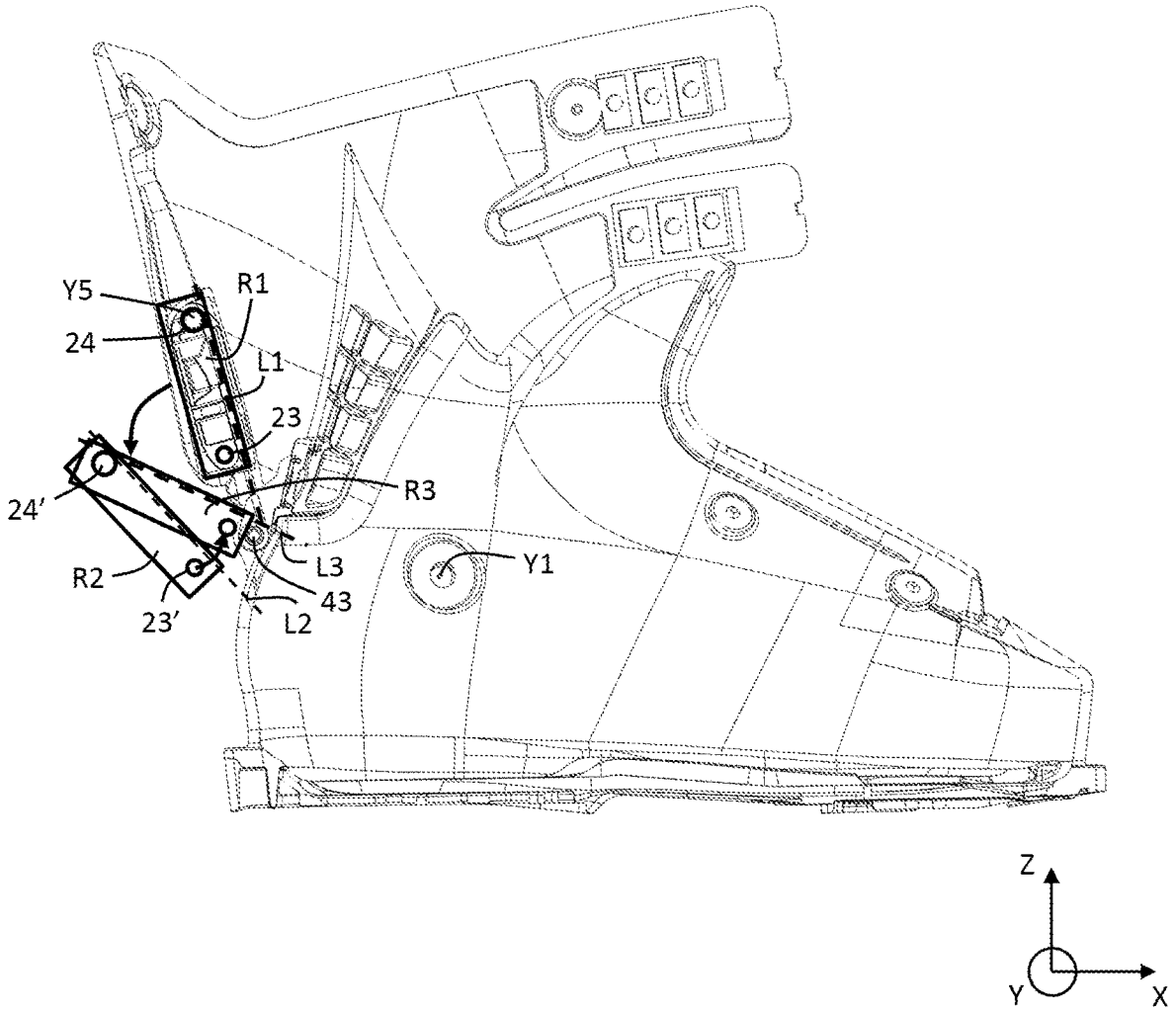
FIG. 13 is a diagrammatic view in section of a part of the ski boot.

The benefit of this kind of fixing of the casing 21 by the rotational coupling about axis Y5 is explained with reference to FIG. 13. In that figure the casing 21 is indicated by a first rectangle R1 and the blade 12 is indicated by a first dashed line L1. A second rectangle R2 represents the position that the casing 21 would assume if the cuff were to pivot toward the rear about the rotation axis Y1, assuming that the casing 21 is rigidly fixed to the cuff. The references 23' and 24' indicate the respective positions of the shafts 23 and 24 in this hypothetical position of the casing. It is seen that in this position the blade 12, represented by the dashed line L2, would no longer pass through the fourth axis Y4. If the casing 21 were rigidly fixed to the cuff the blade 12 would therefore necessarily have to bend to track the movement of casing and/or the amplitude of rotation of the cuff relative to the shell would be reduced. Thanks to the rotation of the casing 21 about the fifth axis Y5 the casing 21 is able to pivot toward the front when the casing is able to pivot toward the front when cuff is pivoted toward the rear. The casing is therefore able to assume the position indicated by the third rectangle R3. In this position the blade 12 can extend in a rectilinear manner inside the casing 21 from the fourth axis Y4, as represented by the dashed line L3. The blade 12 is therefore not flexed and does not interfere with the hinge of the cuff.

The first part 21A of the casing, the carriage 26 and the blade 12 may be metal components, in particular obtained by bending and cutting a metal sheet or plate. The wall 59 of the casing and the blade 12 have facing surfaces liable to rub on one another when the cuff pivots relative to the shell. The locking device advantageously includes a sliding element 44 (visible in FIGS. 9 and 10) between the casing 21 and the blade 12 configured to facilitate the sliding of the blade relative to the casing. The sliding element 44 may for example be a plastic, for example PTFE, plate with non-stick properties, possibly charged with fibres. The sliding element 44 may equally be a non-stick coating applied to any material, in particular a non-stick coating applied directly to the wall 59 forming the bottom of the casing 21. The sliding element 44 may extend between the two flanks 28 of the first part 21A of the casing. The sliding element may be a part independent of the casing or alternatively in one piece with the casing.

Figure 5:
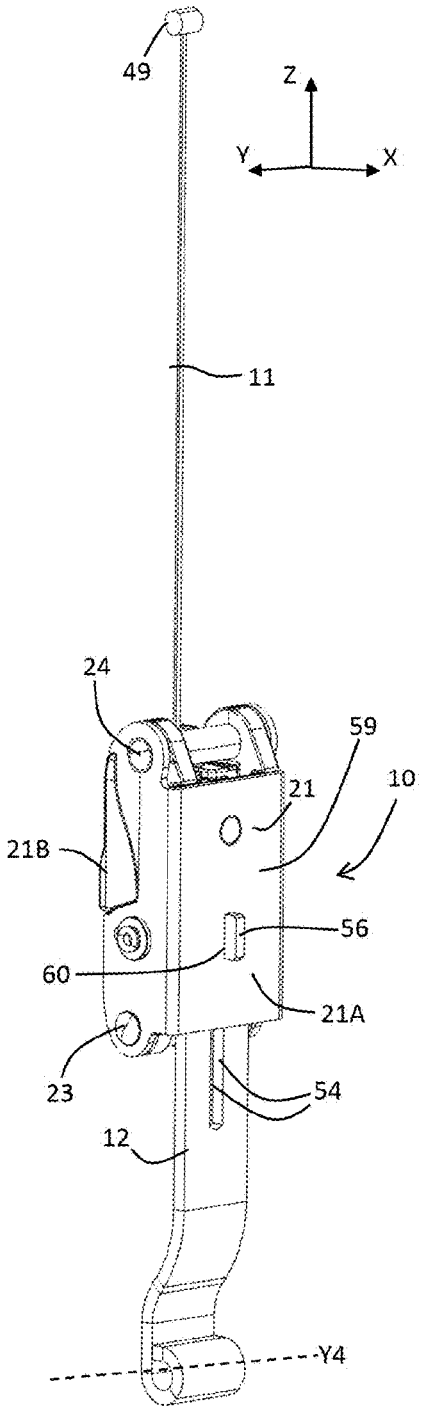
FIG. 5 is a second perspective view of the locking device from FIG. 4.

Note that, as can be seen in FIG. 5, the wall 59 of the casing may advantageously include a second opening 60 intended to receive one end of the immobilising element 22, in particular the second portion 56 of the immobilising element 22, when the latter is in the immobilising position. The second opening 60 has a shape complementary to the shape of said second portion 56, i.e. a rectangular shape in this instance. When the immobilising element 22 is in its immobilising position it is therefore supported both by the shaft 33 and/or by the guide means 25 and at the same time by the edge of the second opening 60. The immobilising element 22 is therefore supported on either side of the blade 12. When practising downhill skiing the high forces that the user exerts on the cuff are supported by the interface between the immobilising element 22 and the blade 12. Supporting the immobilising element 22 on either side of the blade 12 makes it possible to maintain a stable position of the immobilising element 22. This also prevents subjecting the mechanism 20 to forces generated by the user. The immobilising element 22 is therefore not caused to slant by the effect of the high force exerted by the user. There is therefore no risk of it deteriorating. The immobilising element 22 could even be completely supported by the edge of the second opening 60, so as not to generate any stress on the mechanism 20. The sliding element 44 also includes an opening facing the second opening 60 for the second portion 56 of the immobilising element to pass through.

Figure 14:
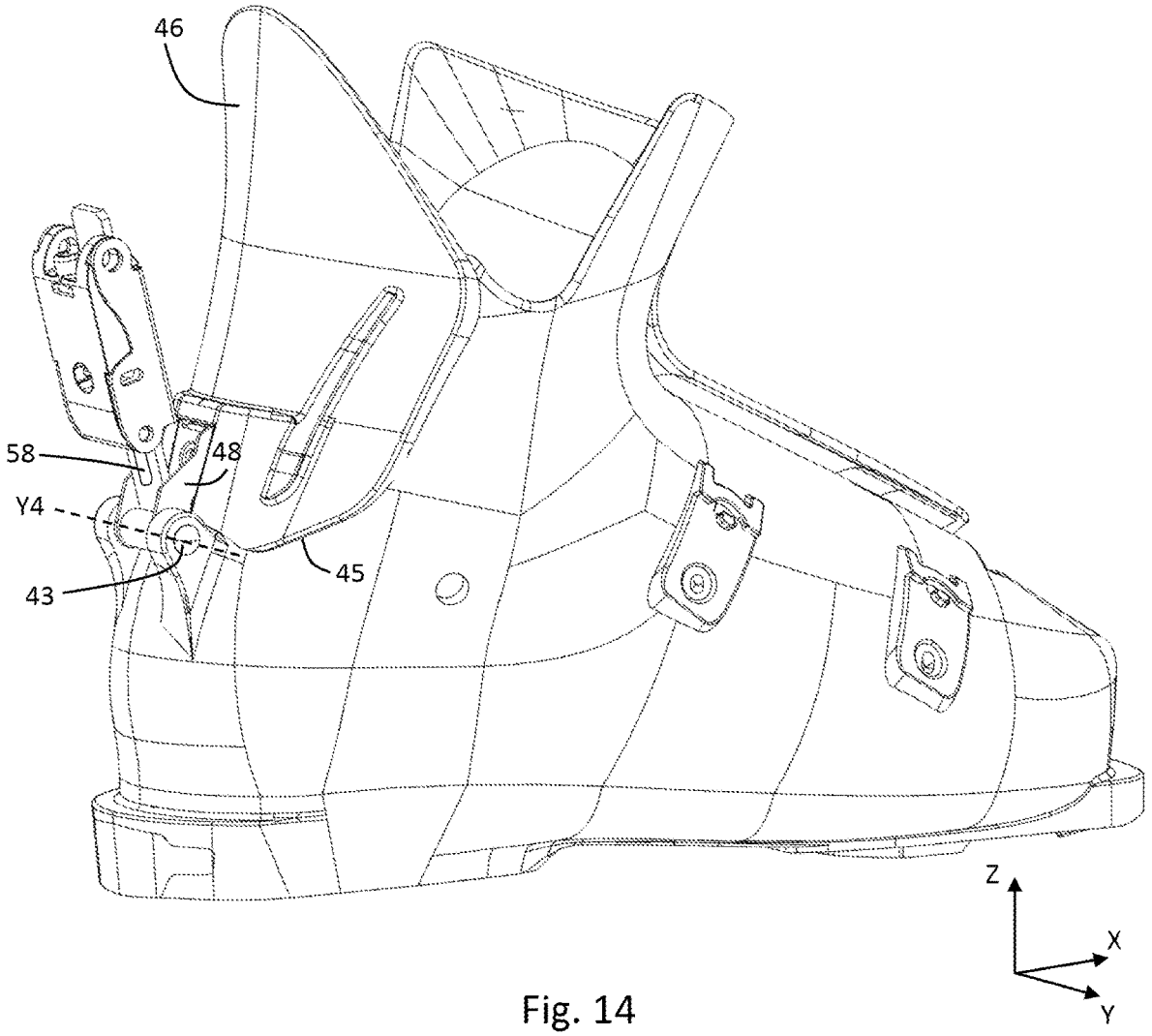
FIG. 14 is a perspective view from the rear of a shell and of a locking device in accordance with one embodiment of the invention.
Figure 15:
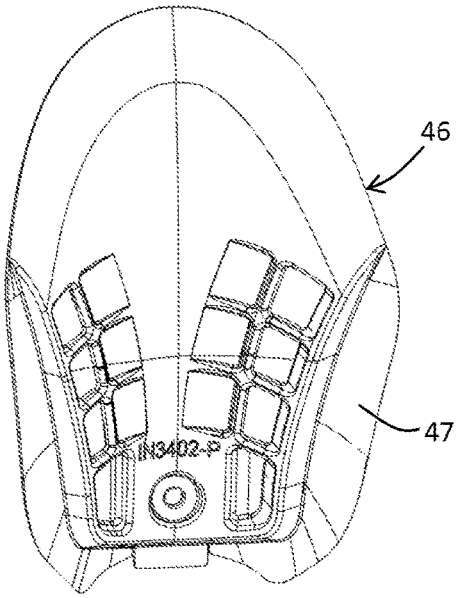
FIG. 15 is a perspective view of a rear spoiler of the shell from FIG. 14.

In accordance with a further aspect of the invention depicted in FIGS. 14 and 15 the shell 2 may include a rear notch 45. The rear notch 45 is a substantially V-shaped or U-shaped opening formed in the upper rear part of the shell 2. The ski boot 1 further includes a rear tongue 46 or rear spoiler 46 mobile in rotation relative to the shell 2 about a transverse axis between a first position and a second position. The rear spoiler 46 closes the notch when it is in its first position and it is pivoted toward the rear when it is in its second position. The rear spoiler 46 includes lateral fins 47 extending along a lower part of the periphery of the rear spoiler 46. The lateral fins 47 are intended to bear on the edges of the rear notch 45 when the rear spoiler 46 is in its first position. A central body of the rear spoiler 46 then fills the notch and the lateral fins 47 cover the rear surface of the shell on either side of the rear notch 45. When the rear spoiler 46 is in its second position the shell offers a large opening toward the rear that further facilitates walking in the ski boot.

The rear spoiler 46 is preferably formed of a single material, in particular a plastic material. Alternatively, the spoiler may be formed of a plurality of materials. In particular, the first material forming the central body of the spoiler may be a rigid plastic material, in particular to confer good resistance to and/or good holding of the lower leg at the rear of the ski boot and the material forming the lateral fins 47 may be a more flexible plastic material, in particular to ensure a good seal of the rear spoiler with the rest of the shell.

The rear spoiler 46 is advantageously mobile in rotation relative to the shell 2 about a transverse axis corresponding to the fourth axis Y4. A support 48, for example in the form of a metal part, is on the one hand fixed rigidly to the rear spoiler 46 and on the other hand fixed to the shaft 43 by a rotational connection about the axis Y4.

When the locking device is in the ski configuration the blade 12 adopts a substantially vertical position that holds the rear spoiler 46 pressed against the edge of the rear notch 45 of the shell. The lower leg is therefore well retained by the rear spoiler and the user can easily press on the cuff with their tibia. When the locking device 10 is in the walk configuration the blade 12 is able to pivot freely about the axis Y4 and therefore no longer retains the rear spoiler 46. The rear spoiler 46 can be pushed toward the rear by the lower leg of the user, which facilitates walking.

The invention claimed is:

1. A sports shoe including:

a shell, a cuff hinged relative to the shell, and a locking device adapted to immobilize a hinge between the shell and the cuff, the locking device including:

an immobilizing element mobile between an immobilizing position and a release position, and a blade fixed to the shell by a rotational connection about a rotation axis, the blade being adapted to be moved relative to the immobilizing element when the immobilizing element is in the release position and the cuff pivots relative to the shell, the blade being adapted to cooperate with the immobilizing element to immobilize the hinge when the immobilizing element is in the immobilizing position, wherein the immobilizing element includes a first guide surface and the blade includes a second guide surface, the first guide surface cooperating with the second guide surface to guide a movement of the blade relative to the immobilizing element when the immobilizing element is in the release position and the cuff pivots relative to the shell, wherein the immobilizing element is mobile parallel to a first axis between the immobilizing position and the release position, the blade is moved relative to the immobilizing element parallel to a second axis when the cuff pivots relative to the shell, the second axis being perpendicular to the first axis, and the first guide surface and the second guide surface are oriented in a direction transverse to the first axis and to the second axis, so as to guide the movement of the blade along the second axis when the immobilizing element is in the release position and the cuff pivots relative to the shell, wherein the blade includes a groove, and the second guide surface is formed by at least one edge of the groove.

2. The sports shoe according to claim 1, wherein the immobilizing element includes a lug, and the blade includes a first opening having a shape complementary to a shape of the lug, the lug cooperating with the first opening when the immobilizing element is in the immobilizing position.

3. The sports shoe according to claim 2, wherein the locking device includes a casing provided with a wall extending against the blade, the blade being intended to be moved relative to the wall when the cuff pivots relative to the shell, the wall including a second opening, the lug being positioned inside the second opening when the immobilizing element is in the immobilizing position.

4. The sports shoe according to claim 2, wherein the groove opens into the first opening.

5. The sports shoe according to claim 2, wherein the immobilizing element includes a first portion adapted to cooperate with the first opening to immobilize the hinge between the cuff and the shell when the immobilizing element is in the immobilizing position, and a second portion having at least one plane face forming the first guide surface.

6. The sports shoe according to claim 1, wherein the immobilizing element is a monobloc element.

7. The sports shoe according to claim 1, wherein the blade includes an upper part extending in a first plane and a lower part extending in a second plane parallel to the first plane and offset relative to the first plane.

8. The sports shoe according to claim 1, wherein the locking device includes a casing fixed to the cuff, the casing including a guide for guiding movement in translation of the immobilizing element parallel to the first axis between the immobilizing position and the release position.

9. A sports shoe including:

a shell, a cuff hinged relative to the shell, and a locking device adapted to immobilize a hinge between the shell and the cuff, the locking device including an immobilizing element mobile between an immobilizing position and a release position, and a conjugate element adapted to cooperate with the immobilizing element to immobilize the hinge when the immobilizing element is in the immobilizing position, the immobilizing element being moved away from the conjugate element to release the hinge when the immobilizing element is in the release position, wherein the locking device includes a shaft secured to the immobilizing element, a casing including at least one first guide opening, a carriage mobile relative to the casing, the carriage including at least one second guide opening, the shaft cooperating with the at least one first guide opening and with the at least one second guide opening so that a movement of the carriage relative to the casing drives a movement of the immobilizing element, wherein the immobilizing element is mobile parallel to a first axis between the immobilizing position and the release position, the at least one first guide opening being oriented parallel to the first axis, the carriage being mobile relative to the casing parallel to a second axis, the at least one second guide opening being oriented parallel to a third axis, the third axis being at a non-zero angle to the first axis, the third axis being at a non-zero angle to the second axis.

10. A sports shoe according to claim 9, wherein the conjugate element includes a blade intended to be fixed to the shell of the sports shoe by a hinge about a rotation axis, the blade being adapted to slide relative to the casing when the immobilizing element is in the release position, the casing and the blade have facing metal surfaces, and the locking device includes a sliding element between the casing and blade, the sliding element being configured to facilitate sliding of the blade relative to the casing.

11. The sports shoe according to claim 9, wherein the locking device further includes a cable, the cable having a first end fixed to the carriage to exert a traction force on the carriage, the cable having a second end fixed to a manoeuvring means of the sport shoe.

12. The sports shoe according to claim 11, wherein the second guide opening is oriented so that movement of the carriage as a consequence of a traction force applied by the cable drives movement of the immobilizing element toward the release position.

13. The sports shoe according to claim 9, wherein the locking device includes return means configured to move the carriage so as to guide movement of the immobilizing element toward the immobilizing position.

14. The sports shoe according to claim 9, wherein the cuff comprises an external wall covering a mechanism of the locking device.

15. The sports shoe according to claim 9, wherein the shell comprises a rear notch, the sports shoe further comprising a rear spoiler rotatable relative to the shell about a rotation axis, the rear spoiler being movable between a first position where the rear spoiler closes the notch and a second position pivoted towards a rear of the shoe.

16. A sports shoe including:

a shell, a cuff hinged relative to the shell, and a locking device adapted to immobilize a hinge between the shell and the cuff, the locking device including:

an immobilizing element mobile between an immobilizing position and a release position, and a blade fixed to the shell by a rotational connection about a rotation axis, the blade being adapted to be moved relative to the immobilizing element when the immobilizing element is in the release position and the cuff pivots relative to the shell, the blade being adapted to cooperate with the immobilizing element to immobilize the hinge when the immobilizing element is in the immobilizing position, wherein the immobilizing element includes a first guide surface and the blade includes a second guide surface, the first guide surface cooperating with the second guide surface to guide a movement of the blade relative to the immobilizing element when the immobilizing element is in the release position and the cuff pivots relative to the shell, wherein the immobilizing element is mobile parallel to a first axis between the immobilizing position and the release position, the blade is moved relative to the immobilizing element parallel to a second axis when the cuff pivots relative to the shell, the second axis being perpendicular to the first axis, and the first guide surface and the second guide surface are oriented in a direction transverse to the first axis and to the second axis, so as to guide the movement of the blade along the second axis when the immobilizing element is in the release position and the cuff pivots relative to the shell, wherein the immobilizing element includes a lug, and the blade includes a first opening having a shape complementary to a shape of the lug, the lug cooperating with the first opening when the immobilizing element is in the immobilizing position, and wherein the locking device includes a casing provided with a wall extending against the blade, the blade being intended to be moved relative to the wall when the cuff pivots relative to the shell, the wall including a second opening, the lug being positioned inside the second opening when the immobilizing element is in the immobilizing position.

* * * * *